313-414 SR
5/28/85 XR 4,520,292

United States Patent [19]
van Hekken et al.
[11] Patent Number: 4,520,292
[45] Date of Patent: May 28, 1985

[54] CATHODE-RAY TUBE HAVING AN ASYMMETRIC SLOT FORMED IN A SCREEN GRID ELECTRODE OF AN INLINE ELECTRON GUN

[75] Inventors: Frans van Hekken, Lancaster; Hsing-Yeo Chen, Landisville, both of Pa.

[73] Assignee: RCA Corporation, Princeton, N.J.

[21] Appl. No.: 492,437

[22] Filed: May 6, 1983

[51] Int. Cl.[3] ..... H01J 29/51; H01J 29/54
[52] U.S. Cl. ..... 313/412; 313/414
[58] Field of Search ..... 313/409, 412, 414, 441, 313/446, 447, 448, 449

[56] References Cited

U.S. PATENT DOCUMENTS

| | | | |
|---|---|---|---|
| B 381,074 | 1/1975 | Hasker et al. | 313/448 |
| 3,771,002 | 11/1973 | Standaart | 313/414 X |
| 3,772,554 | 11/1973 | Hughes | 313/69 C |
| 3,866,081 | 2/1975 | Hasker et al. | 313/449 |
| 4,234,814 | 11/1980 | Chen et al. | 313/412 |
| 4,241,275 | 12/1980 | Yamauchi | 313/413 |
| 4,242,613 | 12/1980 | Brambring et al. | 313/447 |
| 4,251,747 | 2/1981 | Burdick | 313/348 |
| 4,272,700 | 6/1981 | Collins | 313/458 |
| 4,319,163 | 3/1982 | Chen | 315/14 |

FOREIGN PATENT DOCUMENTS

| | | | |
|---|---|---|---|
| 57-90852 | 6/1982 | Japan | 313/409 |
| 58-59534 | 4/1983 | Japan | 313/414 |
| 1230109 | 4/1971 | United Kingdom . | |

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

An inline electron gun for a cathode-ray tube includes a plurality of cathodes, a control grid, a screen grid and a main focus lens arranged successively in alignment with the cathodes for focusing a plurality of electron beams along beam paths onto a screen. The screen grid has a functional grid area with a given thickness. A recessed portion is formed within the functional grid area. A plurality of apertures are formed within the recessed portion of the screen grid. The recessed portion is surrounded by a peripheral rim which is in proximity to the outer apertures thereby affecting the electrostatic field in the vicinity of the outer electron beam paths.

4 Claims, 6 Drawing Figures

CATHODE-RAY TUBE HAVING AN ASYMMETRIC SLOT FORMED IN A SCREEN GRID ELECTRODE OF AN INLINE ELECTRON GUN

BACKGROUND OF THE INVENTION

This invention relates to cathode-ray tubes, and particularly to color cathode-ray tubes of the type useful in home television receivers and color display tubes, and to inline electron guns therefore having a high degree of insensitivity to deflection defocusing of the electron beams.

An inline electron gun is one designed to generate at least two, and preferably three, electron beams in a common plane and to direct the beams along convergent paths to a small spot on the screen. In one type of inline electron gun, such as that shown in U.S. Pat. No. 3,772,554, issued to R. H. Hughes on Nov. 13, 1973, the main electrostatic focusing lenses for focusing the electron beams are formed between two electrodes referred to as the first and second accelerating and focusing electrodes. These electrodes include two cup-shaped members having the bottoms of the members facing each other. Three apertures are included in each cup bottom to permit passage of three electron beams and to form three separate main focus lenses, one for each electron beam. In such electron guns, static convergence of the outer beams with respect to the center beam is usually attained by offsetting the outer apertures in the second focusing electrode with respect to the outer apertures in the first focusing electrode.

An inline electron gun wherein two electrostatic focusing lenses are utilized to form an effective larger main focus lens is described in a copending U.S. patent application Ser. No. 485,860, filed on Apr. 18, 1983, entitled, "Color Picture Tube Having An Improved Inline Electron Gun", by D. J. Bechis, et al., and assigned to the same assignee as the present invention. In the Bechis et al. copending patent application, the third and fifth electrodes from the cathode are electrically interconnected and the fourth and sixth electrodes are electrically interconnected. Facing portions of the fifth and sixth electrodes each include a peripheral rim and three separate inline apertures therein set back from the rim. The peripheral rims are elongated in the inline direction of the inline apertures and form an astigmatic focus field. This field may be matched to an astigmatic beam forming region formed by the first and second electrodes from the cathode.

It has been noted that the horizontal beam landing locations of the outer electron beams, in color picture tubes having the above-described electron guns, change with changes in the focus voltage applied to the electron guns. It therefore is desirable to improve such inline electron guns to eliminate, or at least reduce, this horizontal convergence sensitivity to focus voltage changes.

Copending U.S. patent application Ser. No. 461,584, filed on Jan. 27, 1983 by H. Y. Chen and assigned to the assignee of the present invention, discloses a screen grid structure shown in FIG. 3 of the copending application for reducing the horizontal convergence sensitivity of the inline electron gun to focus voltage changes. The screen grid structure disclosed in the copending Chen patent application utilizes a pair of reconvergence slots formed in the first accelerating and focusing electrode side of the screen grid electrode. The reconvergence slots are formed closely to and inwardly from the outer apertures in the screen grid electrode and cause a refraction of the electrostatic beam path between the screen grid electrode and the first accelerating and focusing electrode to compensate for the offset refraction within the main lens of the electron gun.

An alternative screen grid structure for reducing the sensitivity of the inline electron gun to focus voltage changes is also disclosed in copending U.S. patent application Ser. No. 492,044 entitled, "Cathode Ray Tube Having Asymmetric Slots Formed In A Screen Grid Electrode Of An Inline Electron Gun", filed on May 6, 1983, by H. Y. Chen and assigned to the assignee of the present invention. In the alternative screen grid structure, asymmetric depressions are formed about the outer apertures in the first accelerating and focusing electrode side of the screen grid electrode. In one embodiment, the depressions are transverse slots which also reduce vertical flare which appears on the screen of the tube as an undesirable low intensity tail or smear extending from a desirable intense core of the electron beam. Flare is common in tubes having a deflection angle in excess of 90 degrees.

While the screen grid structures described in the Chen copending patent applications are satisfactory for reducing the horizontal sensitivity of the outer beams with respect to focus voltage changes, a simpler structure that can be easily and inexpensively produced is desired.

SUMMARY OF THE INVENTION

An inline electron gun for a cathode-ray tube includes a plurality of cathodes, a control grid, a screen grid, and electron lens means arranged successively in alignment with the cathodes for focusing a plurality of electron beams along beam paths onto a screen. The screen grid has a functional grid area with a given thickness. A recessed portion is formed within the functional grid area. A plurality of apertures are formed within the recessed portion of the screen grid. The recessed portion is surrounded by a peripheral rim which is in proximity to the outer apertures thereby affecting the electrostatic field in the vicinity of the outer electron beam paths.

DETAILED DESCRIPTION OF THE PREFERRED EMBODIMENTS

Figure 1:
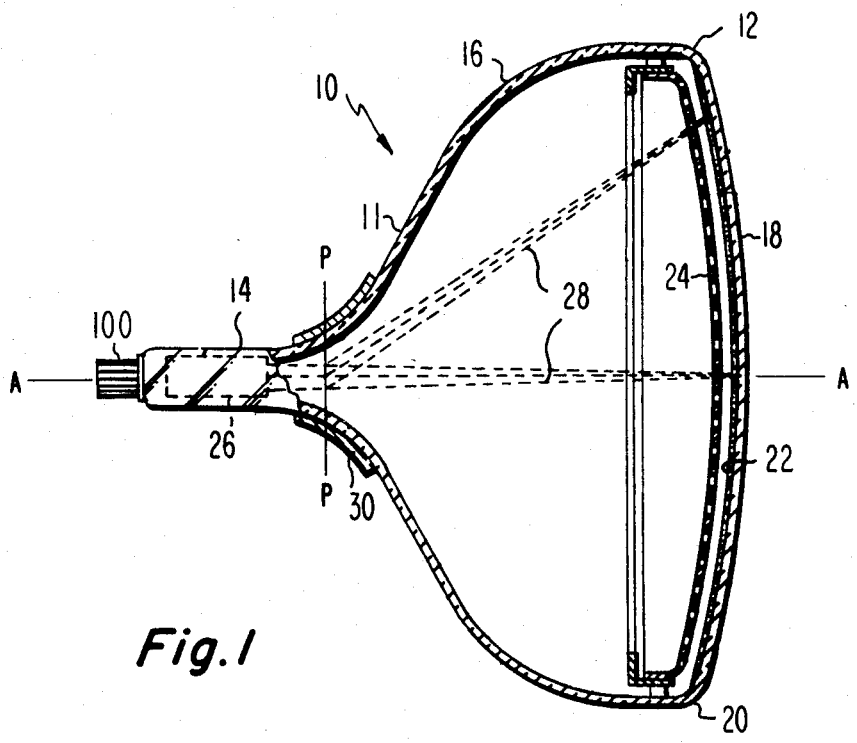
FIG. 1 is a plan view, partly in axial section, of a shadow mask cathode-ray tube embodying the present invention.

FIG. 1 is a plan view of a rectangular color cathode-ray tube 10 having a glass envelope 11 comprising a rectangular faceplate panel or cap 12 and a tubular neck 14 connected by a rectangular funnel 16. The panel comprises a viewing faceplate 18 and peripheral flange or sidewall 20 which is sealed to the funnel 16. A mosaic three-color phosphor screen 22 is carried by the inner surface of the faceplate 18. The screen 22 is preferably a line screen with the phosphor lines extending substantially perpendicular to the high frequency raster line scan of the tube (normal to the plane of FIG. 1). Alternately, the screen could be a dot screen as is known in the art. A multiapertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along spaced coplanar convergent paths through the mask 24 to the screen 22.

The tube of FIG. 1 is designed to be used with an external magnetic deflection yoke, such as the yoke 30 schematically shown surrounding the neck 14 and funnel 16 in the neighborhood of their junction. When activated, the yoke 30 subjects the three beams 28 to vertical and horizontal magnetic flux which cause the beams to scan horizontally and vertically, respectively, in a rectangular raster over the screen 22. The initial plane of deflection (at zero deflection) is shown by the line P—P in FIG. 1 at about the middle of the yoke 30. For simplicity, the actual curvature of the deflected beam paths in the deflection zone is not shown in FIG. 1. A readjustment or change in focus voltage from the optimum focus voltage changes the focus voltage to ultor voltage ratio of the electron gun and results in a change in the relative strength or focal length of the main electrostatic focus lenses with a resulting misconvergence of the outer beams relative to the center beam.

Figure 2:
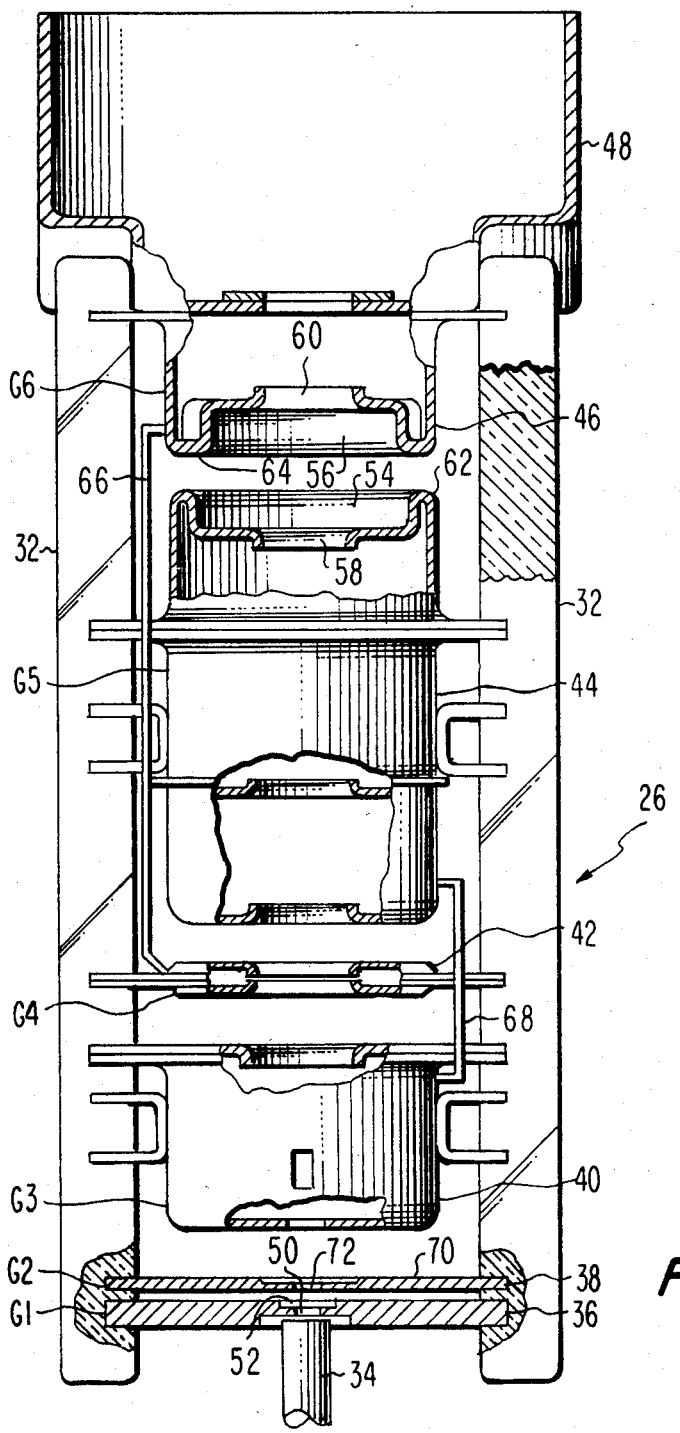
FIG. 2 is a partial axial section view of the electron gun shown in dashed lines in FIG. 1.
Figure 3:
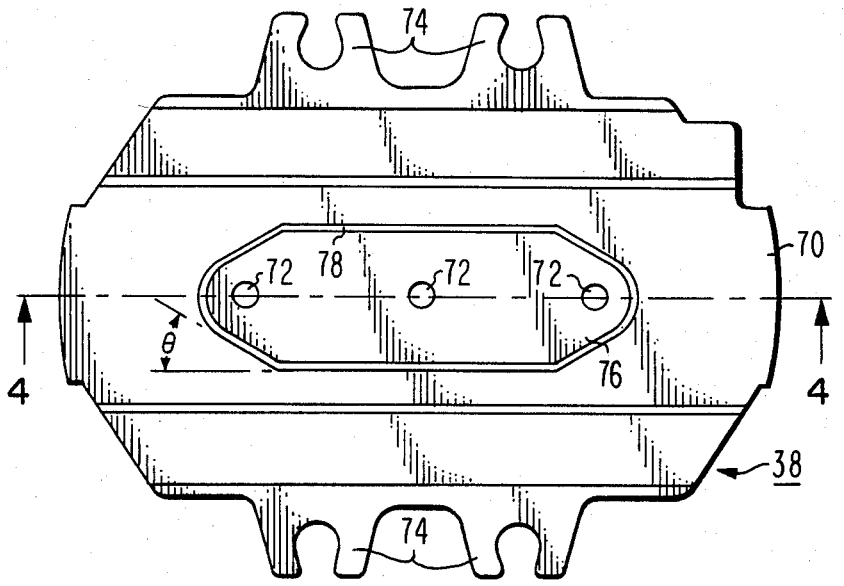
FIG. 3 is an enlarged elevational view of the novel G2 electrode of the electron gun of FIG. 2.
Figure 4:
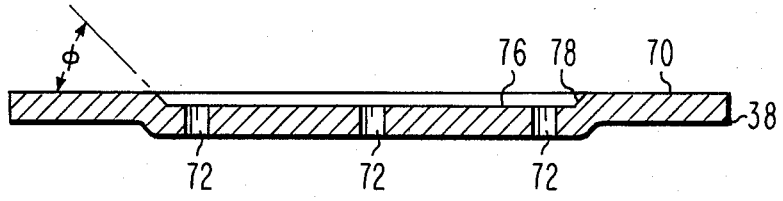
FIG. 4 is an enlarged sectional view of a portion of the G2 electrode of the electron gun, taken along the line 4—4 of FIG. 3.

The details of the improved electron gun 26 are shown in FIG. 2. The gun comprises two glass support rods 32 on which various electrodes are mounted. These electrodes include three equally spaced coplanar cathodes 34 (one for each beam), a beam forming region comprising a control grid electrode 36 (G1) and a screen grid electrode 38 (G2), and a main lens assembly comprising a first focusing electrode 40 (G3), a second focusing electrode 42 (G4), a third focusing electrode 44 (G5), and a fourth focusing electrode 46 (G6), spaced along the glass rods 32 in the order named. A shielding cup 48 is attached to the G6 electrode 46. All of the electrodes have three inline apertures in them to permit passage of three coplanar electron beams. The G1 grid 36 and the G2 grid 38 are parallel plate members that can include embossing therein which add strength to the members and can influence the behavior of the electron beams. In addition to three inline apertures 50, the G1 grid 36 may also include three slots 52 superposed on the apertures, on the side of the grid 36 facing the G2 grid 38. The purpose of the slots 52 will be disclosed hereinafter. The elongated dimension of the slots 52 extends in a direction perpendicular to the inline direction of the apertures. The construction of the main lens assembly is disclosed in the above-referenced Bechis et al. copending patent application, incorporated by reference herein for the purpose of disclosure.

The facing closed ends of the G5 electrode 44 and the G6 electrode 46, as shown in FIG. 2, have large recesses 54 and 56, respectively, therein. The recesses 54 and 56 set back the portion of the closed end of the G5 electrode 44 that contains three apertures 58 from the portion of the closed end of the G6 electrode 46 that contains three apertures 60. The remaining portions of the closed ends of the G5 electrode 44 and the G6 electrode 46 form rims 62 and 64, respectively, that extend peripherally around the recesses 54 and 56. The rims 62 and 64 are the closest portions of the two electrodes 44 and 46 to each other.

The G4 electrode 42 is electrically connected by a lead 66 to the G6 electrode 46 and the G3 electrode 40 is electrically connected by a lead 68 to the G5 electrode 44, as shown in FIG. 2. Separate leads (not shown) connect the G3 electrode 40, the G2 grid electrode 38, the G1 grid electrode 36, the cathodes 34 and the cathode heaters to a base 100 (shown in FIG. 1) of the tube 10 so that these components can be electrically excited. Electrical excitation of the G6 electrode 46 is obtained by a contact between the shield cup 48 and an internal conductive coating in the tube which is connected to an anode button (not shown) extending through the funnel 16.

FIGS. 2, 3, 4 and 5 illustrate in detail a portion of the beam forming region of the electron gun 26. The G2 electrode 38 has a functional grid area 70 with three apertures 72 formed therethrough and aligned with the apertures 50 in the G1 electrode 36. A pair of securing members 74 extend from opposite sides of the functional grid area 70 to attach the electrode 38 to the glass support rods 32. The functional grid area 70 includes a transversely disposed recessed portion 76 through which the apertures 72 are formed. A peripheral rim 78 surrounds the apertures 50 and extends between the recessed portion 76 and the functional grid area 70 of the G2 electrode 38. The recessed portion 76 and the peripheral rim 78 are symmetric with respect to the center aperture 72 but asymmetric with respect to the two outer apertures 72.

In the preferred embodiment, the apertures 72 have a diameter of 0.64 mm (25 mils) and are laterally spaced apart a distance of 5.08 mm (200 mils) center-to-center. The recessed portion 76 has an overall lateral dimension, or length, of about 12.50 mm (492 mils) and a maximum transverse dimension, or width, of about 3.81 mm (150 mils). The maximum width of the recessed portion 76 extends laterally outwardly about 3.94 mm (155 mils) from opposite sides of the center aperture 72 to form a substantially rectangularly-shaped central part. The ends of the recessed portion 76 form an angle, $\theta$, of about 30° with the horizontal and are thus substantially triangularly shaped with the apex of each of the triangularly-shaped end parts being smoothly curved and having a radius of about 1.168 mm (46 mils) measured from the center of the outer apertures. The G2 electrode 38 has a thickness of about 0.71 mm (28 mils) and the recessed portion 76 has a depth of about 0.15 mm (6 mils). The peripheral rim 78 has a shape which forms an angle, $\phi$, of about 63° with a surface of the electrode.

Figure 5:
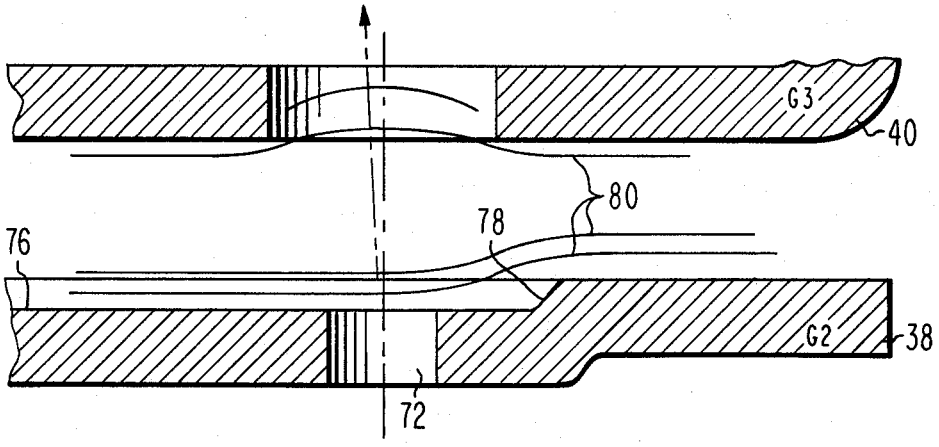
FIG. 5 is an enlarged sectional view of the novel G2 electrode and G3 electrode of the electron gun of FIG. 2, illustrating formation of the electron beam in a horizontal plane.

As shown in FIG. 5, electrostatic equipotential field lines 80 extend between the G2 electrode 38 and the G3 electrode 40 of the electron gun 26. The asymmetric shape and the depth of the recessed portion 76 of electrode 38 as well as the proximity of the peripheral rim 78 to the outer apertures 72 affect the electrostatic field in the vicinity of outer electron beams by tilting the field lines 80 within the recessed portion 76 thereby causing the outer electron beams to horizontally converge toward the center electron beam passing through the center aperture (not shown). The three electron beams are unperturbed in the vertical direction because of the vertical symmetry of the recessed portion 76 and the substantially greater spacing between the apertures 72 and the peripheral rim 78 in the vertical direction. Thus, the recessed portion 76 affects only the horizontal convergence of the outer electron beams for changes in focus voltage. The strength of the aforementioned effect is governed by the depth of the recess and the radius of the triangular end parts thereof. The greater the radius, the farther removed from the outer apertures 72 is the peripheral rim 78, and the deeper the recess must be to affect the paths of the electron beams. In tubes having deflection angles of not greater than 90°, vertical flare is not a problem. However, in tubes having deflection angles in excess of 90°, the addition of the slots 52 superposed on the apertures 50 of the G1 electrode 36 facing the G2 electrode 38 will reduce vertical flare. Such a structure is disclosed in the above-referenced Bechis, et al. copending patent application.

Figure 6:
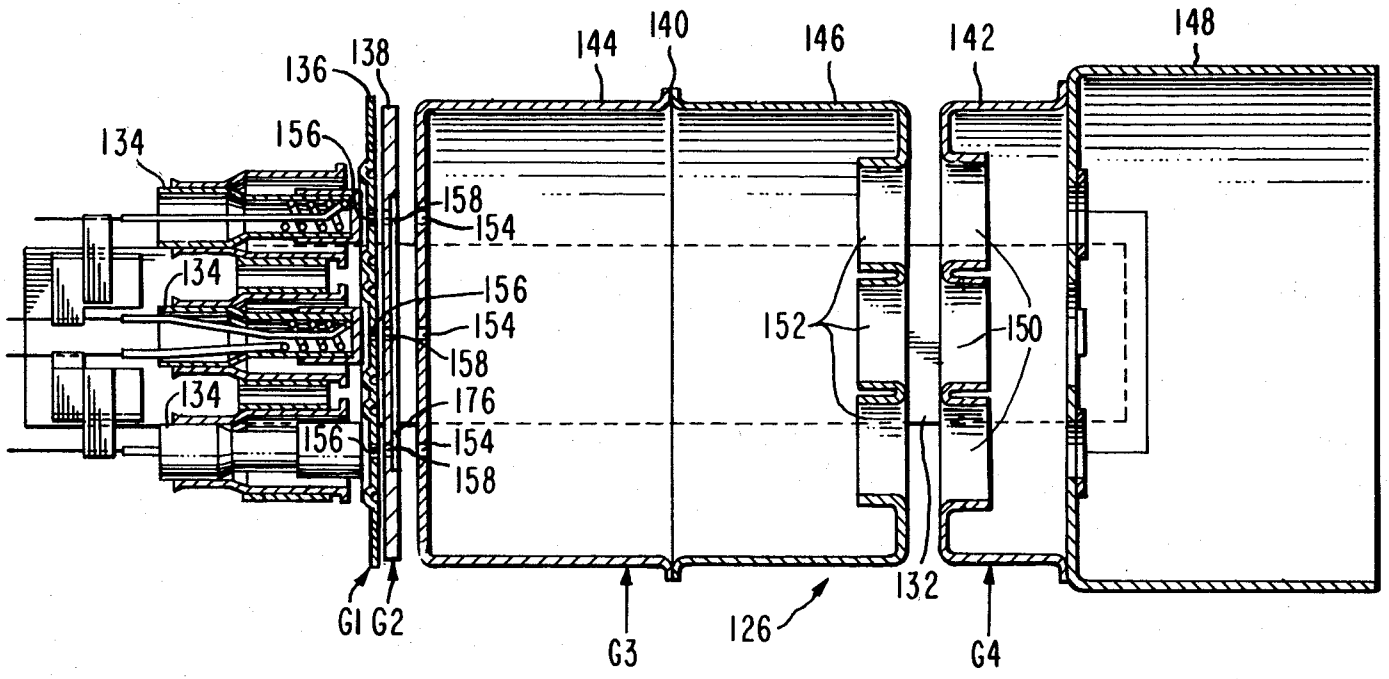
FIG. 6 is a partial axial section view of a second embodiment of an electron gun utilizing the novel G2 electrode.

A second embodiment of the present novel G2 electrode 138 is shown in the inline bipotential electron gun 126 of FIG. 6. The electron gun 126 comprises two glass support rods 132 (one shown) on which various electrodes are mounted. These electrodes include three equally spaced coplanar cathode assemblies 134 (one for each beam), a control grid electrode 136 (G1), a screen grid electrode 138 (G2), a first accelerating and focusing electrode 140 (G3), and a second accelerating and focusing electrode 142 (G4), spaced along the glass rods 132 in the order named. All of the post-cathode electrodes have at least three inline apertures in them to permit passage of three coplanar electron beams. The main electrostatic focusing lens in the gun 126 is formed between the G3 electrode 140 and the G4 electrode 142. The G3 electrode 140 is formed with two cup-shaped elements 144 and 146, the open ends of which are attached to each other. The G4 electrode 142 also is cup-shaped, but has its open end closed with a shield cup 148. The portion of the G4 electrode 142 facing the G3 electrode 140 includes three inline apertures 150, the outer two of which are slightly offset outwardly from corresponding apertures 152 in the G3 electrode 140. The purpose of this offset is to cause the outer electron beams to converge with the center electron beam. However, misconvergence can occur if the focus voltage on the G3 electrode 140 is changed significantly from the optimum focus voltage utilized during the attachment of the yoke (not shown). The side of the G3 electrode 140 facing the G2 electrode 138 includes three apertures 154 which are aligned with apertures 156 in the G1 electrode 136 and with apertures 158 in the G2 electrode 138.

In the alternative embodiment of electron gun 126, the apertures 158 of the G2 electrode 138 have a diameter of about 0.64 mm (25 mils) and are laterally spaced apart a distance of 6.60 mm (260 mils) center-to-center. The G2 electrode 138 is similar to the above-described G2 electrode 38 except that the length and width of the recessed portion 176 are scaled-up to correspond to the larger lateral spacing between the electron beam apertures in the bipotential electron gun 126.

What is claimed is:

1. In a cathode-ray tube comprising an image screen and an inline electron gun for projecting three electron beams along beam paths onto said screen, said gun comprising:

three cathodes for generating said electron beams, a control grid, a screen grid, and a main electron lens arranged successively in alignment with said cathodes for focusing said electron beams, said control grid and said main electron lens having three apertures disposed in a plane for passing said electron beams, said screen grid having a functional grid area with a given thickness, said screen grid having three apertures formed within said functional grid area and aligned with said apertures in said control grid, the improvement wherein said screen grid includes a transversely disposed recessed portion having a substantially rectangularly-shaped central part and substantially triangularly-shaped end parts, the apex of each of the triangularly-shaped end parts being smoothly-curved, said recessed portion having said apertures therein, said recessed portion being surrounded by a peripheral rim which conforms to the shape of said recessed portion, the substantially rectangularly-shaped central part of the rim is remote from the central aperture and the triangularly-shaped end parts of the rim are in proximity to the outer apertures thereby affecting the electrostatic field in the vicinity of the outer beam paths by tilting the field lines within said recessed portion causing the electron beams passing through the outer apertures to converge toward the center electron beam.

2. The tube as defined in claim 1, wherein said recessed portion has a length of about 12.50 mm and a width of about 3.81 mm at the widest part.

3. The tube as defined in claim 2, wherein the smoothly curved end parts of said recessed portion have a radius of about 1.168 mm measured from center of the outer apertures.

4. The tube as defined in claim 3, wherein said recessed portion has a depth of about 0.15 mm.

* * * * *

UNITED STATES PATENT AND TRADEMARK OFFICE

CERTIFICATE OF CORRECTION

PATENT NO. : 4,520,292

DATED : May 28, 1985

INVENTOR(S) : Frans van Hekken et al.

It is certified that error appears in the above-identified patent and that said Letters Patent is hereby corrected as shown below:

ON ABSTRACT SHEET:

[75] "Hsing-Yeo Chen" should be -- Hsing-Yao Chen -- .

Signed and Sealed this

*Twenty-sixth* Day of *November 1985*

[SEAL]

*Attest:*

DONALD J. QUIGG

*Attesting Officer*

*Commissioner of Patents and Trademarks*